United States Patent [19]

Uyemura

[11] Patent Number: 4,864,720

[45] Date of Patent: Sep. 12, 1989

[54] TRAVELLER SETTER

[75] Inventor: Kohichi Uyemura, Kobe, Japan

[73] Assignee: Kanai Juyo Kogyo Kabushiki Kaisha, Japan

[21] Appl. No.: 105,601

[22] Filed: Oct. 8, 1987

[51] Int. Cl.[4] ..... B23P 19/04

[52] U.S. Cl. ..... 29/765

[58] Field of Search ..... 29/765, 229, 241

[56] References Cited

U.S. PATENT DOCUMENTS 4,373,247 2/1983 Holenstein et al. ..... 29/765
4,575,933 3/1986 Nett ..... 29/765

FOREIGN PATENT DOCUMENTS 407218 4/1940 Japan .
403168 11/1940 Japan .
60-99025 6/1985 Japan .

*Primary Examiner*—Bruce Y. Arnold
*Assistant Examiner*—J. Ryan
*Attorney, Agent, or Firm*—Wenderoth, Lind & Ponack

[57] ABSTRACT

A traveller setter having a main mechanism which includes a traveller holder with a guide on the undersurface of a forward end thereof and a magnet arranged at the upper part of said ring flange receiving seat, a traveller engaging hook at a forward end portion thereof for engaging a traveller held by the magnet with a ring flange, a traveller supplier for supplying travellers to the traveller holder. The main mechanism can be encased in a case when not in use by making the traveller engager slidable by a working pin. This traveller setter ensures accurate setting of travellers on ring flanges and requires no skill in handling.

11 Claims, 14 Drawing Sheets

(A)

(C)

(B)

(A)

(B)

(C)

TRAVELLER SETTER

BACKGROUND OF THE INVENTION

1. Field of the Invention

This invention relates to a traveller setter for setting a traveller on a ring for ring spinning or twisting.

2. Description of the Prior Art

Conventionally, a traveller is set on a ring flange in such a way that at first it is hung on a tapered rod of small diameter (about $\phi$ 1 mm), for example, and one end or one leg portion of the traveller is applied to the ring flange and then the rod is pulled outwardly as the traveller is pressed down by fingers. However, it is often the case with such traveller setting procedure that the rod is pulled more than necessary and the opening of the traveller is widened, which can cause "traveller fly off".

In order to eliminate the above problem, a traveller setting device as disclosed by Japanese Laid-open patent application No. 60-99025 has been suggested. This device, however, also involves deformation of the traveller and resultant "traveller fly off" and traveller breakage because it requires the action of pulling outwardly a rod passed through a traveller.

Japanese Utility Model Application Publication No. 40-31687 also suggests a traveller setting device. In this device, a spring is provided at one end of a guide on which many travellers are arranged in a row and travellers are pushed out one by one by the pressing force of the spring for locating a traveller prior to setting on the ring flange. This device, however, often involves the problem that the arrangement of travellers in a row is disordered when each traveller is pushed out by the pressing force of the spring, with the result that leg portions of adjoining travellers get tangled together and travellers are not supplied normally to the ring flange part, and hence unsatisfactory setting of travellers on the ring flange occurs.

SUMMARY OF THE INVENTION

The present invention has been made for the purpose of eliminating the problems mentioned above. It comprises mainly (1) a traveller holding means with a guide seat at the undersurface of its forward end portion and a magnet at the upper part of said guide seat, (2) a traveller engaging means having at its forward end portion a hook for engaging a traveller held by said magnet with the ring flange and (3) a traveller supplying means to supply travellers to the magnet of said traveller holding means. The traveller engaging means is adapted to be slidable by a working member and all of these means are kept in a case when not in use. More particularly, the traveller holding means is a plate-like main member provided with a guide seat at the undersurface of its forward end portion, a protrusion which is continuous with said guide seat and protrudes downwardly and a magnet at the side of the guide seat and the protrusion; the traveller engaging means is a plate-like setting member having at its forward end a hook with an inner surface which is curved so as to hold the back of a traveller; and the traveller supplying means is a sub member having a traveller guide rail which is bent at its forward end toward the holding surface of the magnet and which is adjustable by a gauge adjusting screw. A main mechanism is constructed by engaging in guide grooves provided at the desired position of a setting member cam followers provided between the main member and the sub member and by positioning the setting member slidably between the main member and the sub member. The main mechanism is encased slidably in a case in such a fashion that a working member provided in the case and the setting member cooperate with each other.

The present invention provides a traveller setter of the above construction by which a traveller is held stably in the desired position by the traveller holding magnet provided on the main member, travellers are prevented from getting tangled with each other at their leg portions and travellers are set on a ring flange accurately without deformation by applying an opened part of a traveller to the inside of a flange by holding and pressing the back of the traveller by the hook of the setting member which moves and then pushing in the traveller.

BRIEF DESCRIPTION OF THE DRAWINGS

The nature of the present invention will be understood more clearly from the following description made with reference to the accompanying drawings, in which:

FIGS. 1–8 show a first embodiment of a traveller setter according to the present invention, in which FIG. 1 is a perspective view of the traveller setter, FIG. 2 is a perspective view of an assembly, FIG. 3A is a perspective view of a forward end portion of a main member, FIG. 3B is an exploded perspective view of the main member, FIG. 3C is a front view of a guide seat 17, FIG. 3D is a front view of a main part of a different embodiment of the guide seat, FIG. 4A is an exploded perspective view of the front part of a setting member, FIG. 4B is a side view of a main part thereof, FIG. 4C is an enlarged view of a guide groove therein, FIG. 5 is an exploded perspective view of a main mechanism, FIG. 6A is a perspective view of a gauge adjusting screw, FIG. 6B is an exploded perspective view thereof, FIG. 7 is an exploded perspective view of the traveller guide rail and a traveller guide bar, FIG. 8 is an exploded perspective view of a working pin.

FIGS. 10–16 show a second embodiment of the traveller setter according to the present invention, in which FIG. 10 is an exploded perspective view of a main mechanism, FIG. 11 is a perspective view of a different embodiment of the main member 88 thereof, FIG. 12 is an exploded perspective view showing how the traveller guide rail and the traveller guide bar are assembled, FIG. 13 is an exploded perspective view of the traveller setter, FIG. 14 is an exploded perspective view of a working member thereof, FIG. 15A is a perspective view of an assembled traveller setter in the normal position, FIG. 15B is a perspective view of the setter in use, FIG. 15C is a right end view thereof, FIG. 15D is a left end view thereof, FIG. 16A is a plan view of the mechanism of the setter with the case shown in phantom lines, FIG. 16B is an elevation view of FIG. 16A with the setter as it is in use;

FIGS. 19–23 show a third embodiment of the traveller setter according to the present invention, in which FIG. 19 is an exploded perspective view of the main mechanism of the traveller setter, FIG. 20 is a perspective view of the assembled main mechanism, FIG. 21 is an exploded perspective view of the case, FIG. 22 is a perspective view of the setter enclosed in the case, and FIG. 23 is a perspective view of the setter as it is during use.

DETAILED DESCRIPTION OF THE INVENTION

First Embodiment

Figure 1:
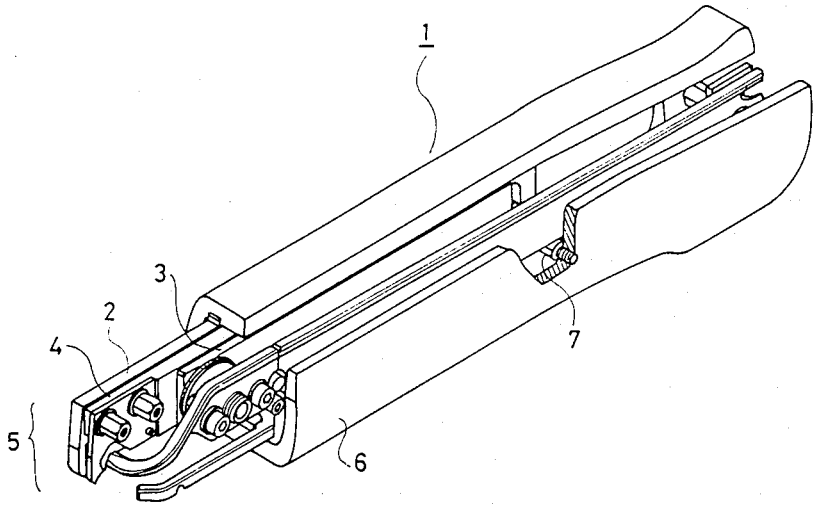
Figure 2:
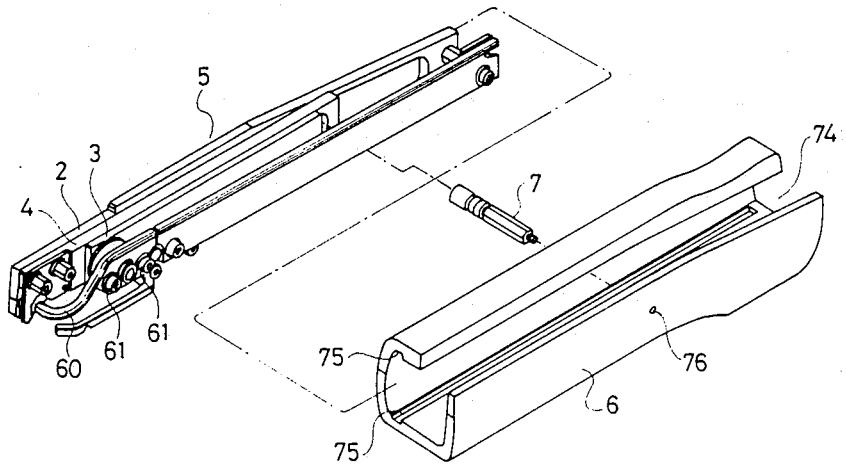

As shown in FIGS. 1 and 2, a traveller setter 1 comprises a main mechanism 5 provided with a plate-like main member 2, a sub member 3 and a plate-like setting member 4 which is provided slidably between the main member 2 and sub member 3, a case 6 in which the main mechanism 5 is slidably received and a pin-like working member 7 which connects the setting member 4 with the case 6. A description is given below of the main mechanism 5.

Figure 3:
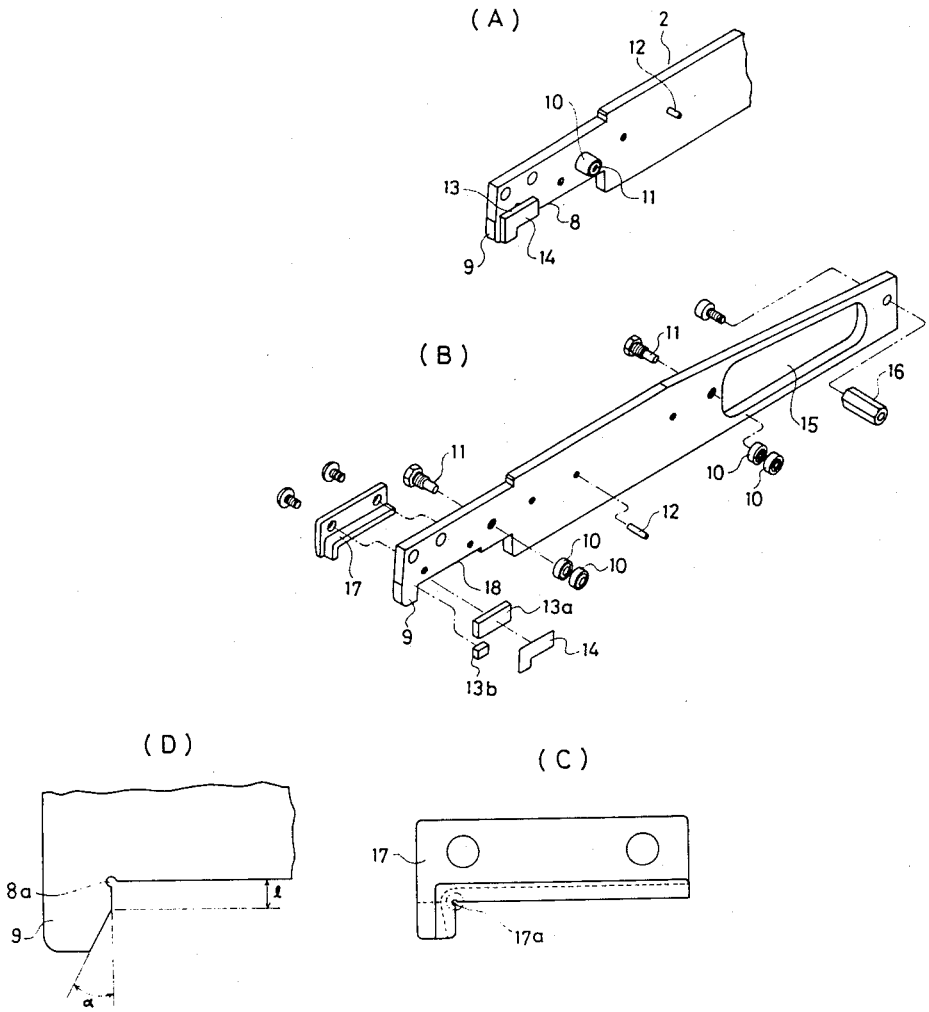

As shown in the parts of FIG. 3, the main member 2 which is positioned on the outside of the main mechanism 5 has a steel plate and has at the under side of a front portion thereof a guide seat 8 which is adapted to be placed in sliding contact with a ring flange and a protrusion 9 which is continuous with the guide seat 8 and is bent downwardly. Inner surfaces of the guide seat 8 and the protrusion 9 (surfaces which make contact with the ring flange) can be protected by an abrasion-resistant cover. Provided at one side of the main member 2 are cam followers 10 which are supported rotatably on pins 11 arranged at the required intervals. A spring pin 12 protrudes from the substantially central part of the main member 2.

As shown in FIG. 3B, two cam followers 10 having a length one half of the length of the cam follower shown in FIG. 3B can be mounted on each pin 11.

A magnet 13 of L-like shape for holding a traveller is provided at the side, ranging from the guide seat 8 of the main member to the protrusion 9, and where necessary, a thin plate 14 is fixed to the surface of the magnet 13 with a cyanocrylate or epoxy adhesive or the like. These parts together constitute a traveller holding means. The plate 14 is made of SK steel plate and has almost the same shape as the magnet 13. Where necessary, the plate 14 is bent inwardly at its lower edge so as to cover the undersurface of the magnet 13. A large hole 15 through which a pin-like working member 7 is passed is provided at the rear part of the main member 2. A block 16 for receiving a traveller guide bar 67 is detachably mounted to the rear of the hole 15.

In this embodiment, as shown in FIG. 3B, the guide seat can be a separate element 17 of wear-resistant high molecular material, such as polyamide, polyacetal, high-density polyethylene or the like, and can be detachably mounted in contact with a fitting surface 18 (at the undersurface of the front part of the main member 2) and the protrusion 9 so that the ring flange will not be damaged and the guide seat can be replaced when it becomes worn. As shown in FIGS. 3C and 3D, concavities 8*a* and 17*a* which are yarn gripping parts are provided at the interior corners of the guide seats 8 and 17. Also, the inside surface of the protrusion 9 (the surface which makes contact with the inside surface of the ring flange) can, as shown in FIG. 3D, be a surface having a straight line profile of about 1 mm in length (l) and an angle of inclination of about 30° (λ) so that when a traveller has been set wrong, the ring flange part slips along the inclined part of the protrusion 9 and the traveller setter will come off the ring flange part, whereby wrong traveller setting is confirmed. The inclined straight surface can be provided on the inner side surface of a protrusion of the guide seat 17.

The magnet 13 has an L-like shape but as shown in FIG. 3B, it can be formed by the combination of two rectangular magnets 13*a* and 13*b*. The magnet 13 is fixed to the side of a top end of the main member 2 with a cyanocrylate or epoxy adhesive or the like. The magnet 13 is preferably a rare-earth magnet of 8–9 (KG) residual magnetic flux density, having a coercive force of 7,800–9,000 (Oe) and maximum energy product of 16–19 (MG×Oe), and the two magnets 13*a* and 13*b* attract each other by magnetic force.

Figure 4:
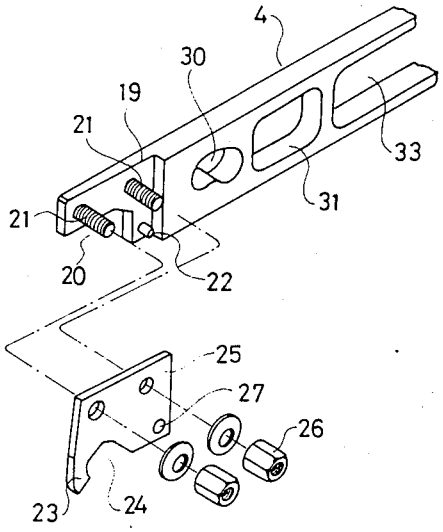
Figure 4:
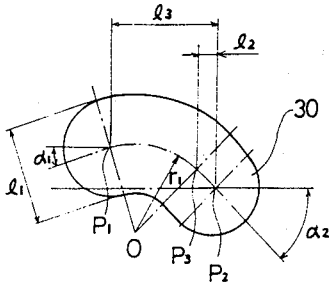
Figure 4:
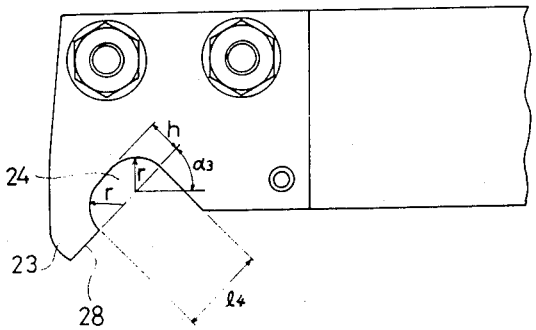

As shown in FIG. 4, the setting member 4 is made of steel plate and a shoulder part 19 is provided at its front end portion. A notch 20 is formed in the shoulder part 19. Screws 21 for attaching a traveller setting plate 25 and a spring pin 22 for locating the plate 25 are provided on the shoulder part 19.

The traveller setting plate 25 has a hook 23 for carrying out traveller setting at the lower part of its forward end. A notch 24 is defined by the hook 23. The setting plate 25 detachably mounted on the shoulder part 19 by screws 21 and nuts 26 so that it is replaceable with another setting plate having a hook of different thickness, according to the thickness of the traveller.

Locating of the traveller setting plate 25 is carried out by engaging a hole 27 for locating formed in the plate 25 over the spring pin 22 and by placing the nuts 26 on screws 21.

As shown in FIG. 4B, the end surface 28 of the hook 23 is inclined so that it makes an angle of about 45° (angle $\alpha_3$) with a horizontal line. The notch 24 which is continuous with the rear end of the end surface 28 of the hook is 3 mm in depth (h) and 7.5 mm in length ($l_4$) and both corners of its base are curved surfaces of 3 mm in radius (r) and connected by a straight line. The depth (h), the length and the corner part of the notch 24 are within the range of $\alpha_3=45°-60°$, $h=3-4$ mm, $l_4=6-8$ mm and $r=3-4$ mm.

Figure 5:
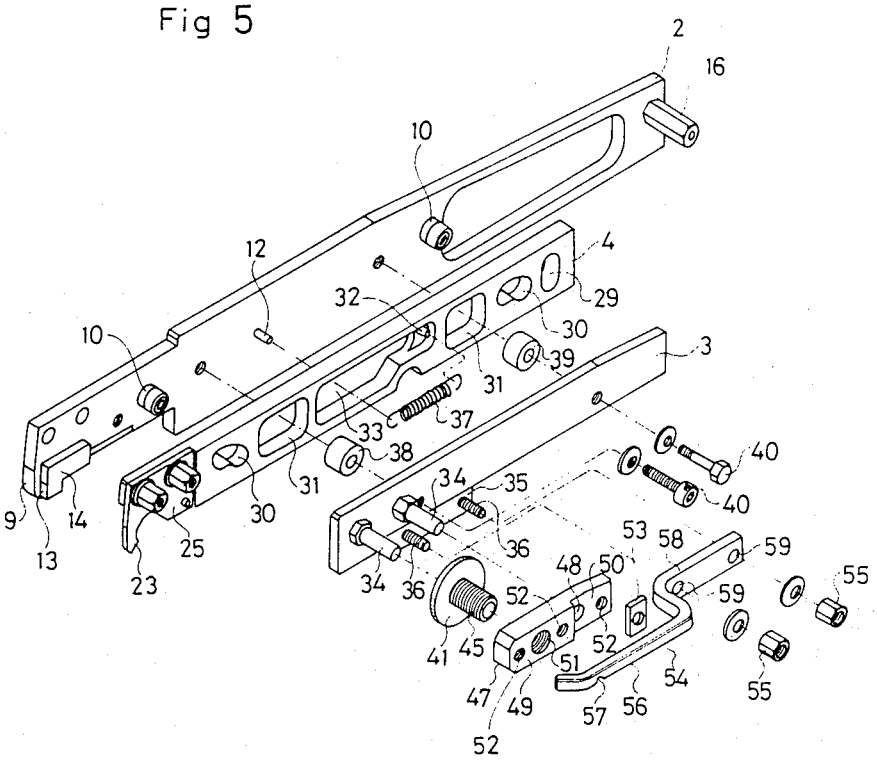

As shown in FIG. 5, provided at the rear end portion of the setting member 4 is a hole 29 through which the working member 7 passes and substantially at the central part is an opening 33 having a spring pin 32 for attaching a tension spring 37. A guide groove 30 and an opening 32 are provided between the hole 29 and the opening 33 and a further opening 31 and a further guide groove 30 are provided between the shoulder part 19 and the opening 33, and the required space therebetween.

The guide groove 30 is a hole of kidney-like shape and engages with the cam follower 10 of the main member 2 to give a fixed directionality to the movement of the setting member 4. More particularly, the guide groove 30 has a groove width ($l_1$) of 6G7 and circular arcs of radius $\frac{1}{2}l_1$ at front and rear ends. The angle $\alpha_1$ and the angle $\alpha_2$ formed by horizontal lines passing the center of these circular arcs and the central lines of the arcuate curves $P_1$ and $P_2$ are about 20° and about 45° respectively. The circular arcs of the guide groove are connected by a straight line portion at the back and by the same radius of curvatures ($r_1$) at the other. In the drawing, the horizontal distance $l_2$ between P2 and P3 is 1 mm, the horizontal distance $l_3$ between P1 and P2 is 6.5 mm and the radius $r_1$ of OP1 and OP3 is 5.5 mm.

As shown in FIG. 5, the sub member 3 which is positioned on the inside of the main mechanism 5 is made of steel plate. It has side pins 34 at a side part of a front end portion thereof and screws 36 (for a bar 54 for determining position) on a shoulder part 35 formed at the lower part thereof.

A description is made about assembling of a main mechanism using the main member 2, sub member 3 and the setting member 4.

As shown in FIG. 5, the main member 2 and the setting member 4 are arranged in such a fashion that cam followers 10 of the main member 2 are fitted slidably in guide grooves 30. A tension spring 37 is hitched to the spring pin 12 and the spring pin 32 on the main member 2 and the setting member 4, respectively, in the opening 33. This tension spring 37 has a tension of about 400 g at the time of assembling and about 670 g at the time of maximum action.

The main member 2 and sub member 3 are fastened by bolts 40 through the medium of a spacer 38 and a stopper 39. A gauge adjusting screw 41 is rotatably mounted on a slide pine 34 at a front part of the sub member 3. A traveller supplying means is constituted by a traveller guide member (to be described later) through the medium of the gauge adjusting screw 41.

Figure 6:
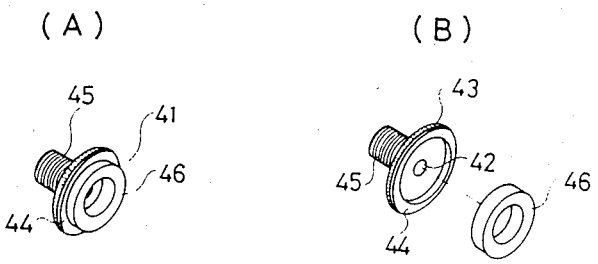

As shown in FIGS. 6A and 6B, the gauge adjusting screw 41 has a hole 42 at its center in which the slide pin 34 is inserted and comprises an adjusting screw head 44 with knurls 43 on its periphery and a threaded part 45 which is fixed to one side of the screw head 44 and has a through hole in which the slide pin 34 is inserted at its center and a male thread on its periphery. Fixed to the other side of the screw 44 by an adhesive is an annular magnet 46 which is preferably a rare-earth magnet having 8–9 (KG) residual flux density, 7,800–9,000 (Oe) coercive force and 16–19 (MG×Oe) maximum energy product.

A guide bar fitting plate 47 is threadedly engaged with the threaded part 45 of the gauge adjusting screw 41 and one of the slide pins 34 at the sub member 3 is put through a slide hole 48 in the guide bar fitting plate 47.

As shown in FIG. 5, the guide bar fitting plate 47 is made of steel and comprises a plate 49 having a shoulder part 50. A female threaded hole 51 is bored in the plate 49 and the slide hole 48 is provided in the shoulder part 50. Threaded holes 52 for mounting a traveller guide rail and a traveller guide bar are provided on both sides of the hole 51 and at the end portion of the shoulder part 50. A rubber cushion 53 with a hole is fixed by an adhesive around the hole 52 in the shoulder part 50 in such a fashion that the hole in the cushion 53 corresponds with the hole 52.

The bar 54 for determining position is detachably mounted by nuts 55 on the screws 36 provided on the shoulder part 35 of the sub member 3. The bar 54 for determining position is made of steel and has at one end a ring flange contacting part 56 and yarn gripping recess 57 which is concave (about 0.5 mm in radius and about 0.5 mm in depth). The other end of the bar 54 has a mounting part 58 for mounting the sub member 3 and has holes 59.

The bar 54 is mounted in such a way that the undersurface of the ring contacting part 58 is positioned on almost the same horizontal plane as the undersurface of the guide seat 8 of the main member 2 and this horizontal plane at a right angle to the traveller holding surface of the plate 14 on the magnet 13.

Figure 7:
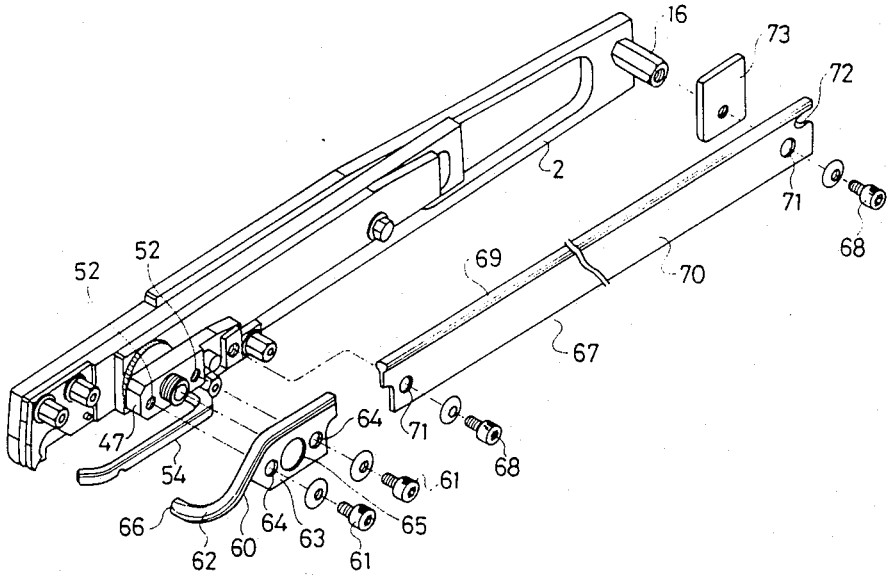

As shown in FIG. 7, a traveller guide rail 60 is detachably mounted on guide bar fitting plate 47 by bolts 61.

The traveller guide rail 60 comprises a rail part 62 and a mounting part 63 in which holes 64 and a hole 65 are made. The rail part 62 is curved downward at an angle of about 45° at substantially the central part and is straight for a length of 3 mm at its forward end. The cross-sectional shape of the rail part 62 is almost the same as the traveller inner circular shape which is 4 mm in width, 2.5 mm in height and 0.8 mm inside rounded parts at the four corners. A protrusion 66 can be provided at the upper surface or at the upper surface and the side surface of the straight part.

The rail part 62 is made of non-magnetic metallic material, such as steel SUS 304, brass, phosphor bronze and the like, or engineering plastic material, such as polyamide and the like in order to insure regular alignment of the traveller.

The traveller guide bar 67 comprises a rail part 69 and a mounting part 70. The cross-sectional shape of the rail part 69 is the same as or similar to that of the rail part 62 of the traveller guide rail 60. The mounting part 70 can be attached to the front and rear portions of the rail part 69 respectively, instead of one mounting part extending over the whole length of the rail part 69. A cutting edge 72 can be provided at the rear end of the mounting part 70.

In mounting the traveller guide bar 67, a traveller stopper 73 of urethane (2 mm in thickness, 10 mm in width, 17 mm in height and 60° in hardness) can be interposed between the block 16 and the mounting part 70. If this traveller stopper 73 is interposed in such a fashion that it projects upward or rearward from the rail part 69, placing of travellers onto the rail part 69 can be made easy.

The case of the main mechanism 5 constructed as described above has an opening 74 and the main member 2 is put in the cylindrical case 6. As shown in FIG. 2, the case 6 has grooves 75 at the upper and lower inside corners, in which upper and lower surfaces of the main member 2 are slidably engaged. The working member 7 is put in a hole made in one side of the case (not shown), passed through the hole 15 of the main member 2 and the hole 29 of the setting member 4 and is screwed in a threaded hole 76 in case 6. Thus, a traveller setter is constructed.

Figure 8:
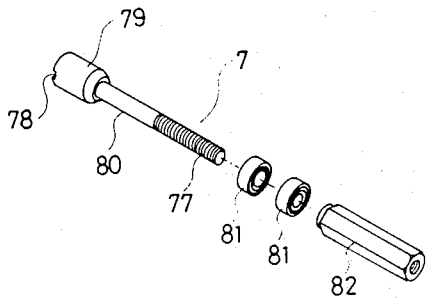

The working member 7 has an abrasion-resistant cylindrical body or, as shown in FIG. 8, it can be composed of a shaft 80 having a threaded part 77 (which is screwed in the hole 76 of the case 6) at one end thereof and a head part 79 (which is inserted in a hole in the case 6) and has a slit at its end surfaces at the other end, roller followers 81 on the shaft and a nut 82.

Figure 9:
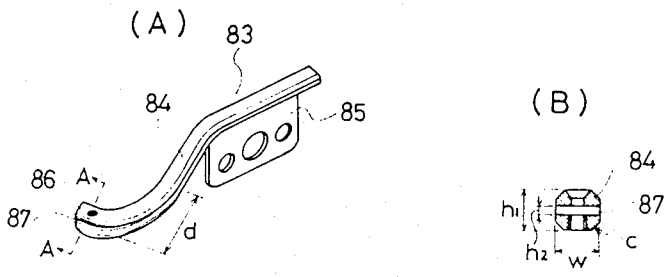
FIG. 9A is a perspective view of a further embodiment of the traveller guide rail.
FIG. 9B is a cross-sectional view thereof, taken along the line A—A in FIG. 9A.

FIG. 9A and 9B show another embodiment of the guide rail. A guide rail 83 is composed of a rail part 84 and a mounting part 85. The rail part 84 has a slit 87 (about 15 mm in depth d) at its top end portion 86. The cross-sectional shape of the rail part 84 is, as shown in FIG. 9B, 2.5 mm in height h, 4.0 mm in width W and 0.8 mm inside corner beveled parts C at the four corners. The slit 87 is at about the center of the height $h_1$ of the rail part 84, with a width $h_2$ of 0.3 mm, but is widened to a width of 1 mm at its extreme end. A silicon rubber compression spring (about 1 mm in inside diameter, about 4 mm in outside diameter, about 0.8 mm in thickness and about 60° in hardness) is disposed in the slit 87 so that the size of the slit 87 can be adjusted by a screw. This adjustment is carried out according to the kind of traveller in order to ensure a smooth stream of travellers.

If a magnet is embedded in or adhered to the ring flange contacting part 56 of the position determining bar 54 which makes contact with the ring flange, the position of the traveller setter can be stabilized.

Second Embodiment

Figure 10:
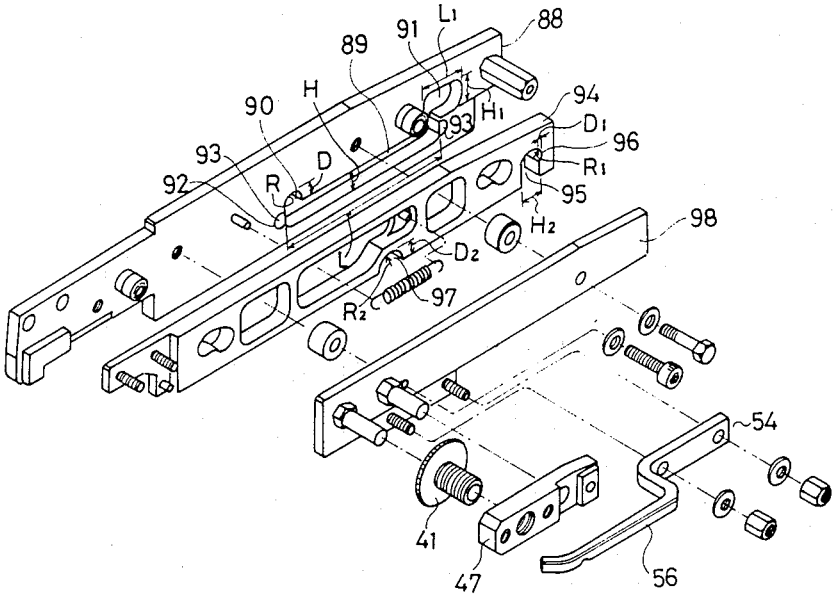

As shown in FIG. 10, a main member 88 is almost the same as in the first embodiment. A groove or slot 89 (6 mm in width H) is provided having a length L of about 56 mm. A notch 90 of substantially semicircular shape (about 3 mm in radius R) is made at the upper front part of the groove 89 with a depth D of about 4 mm. A groove 91 is made at the rear upper part of the groove 89 with a height $H_1$ of about 100 mm or more and with a length $L_1$ of about 12 mm. The groove 91 and the groove 89 are connected with each other.

Figure 11:
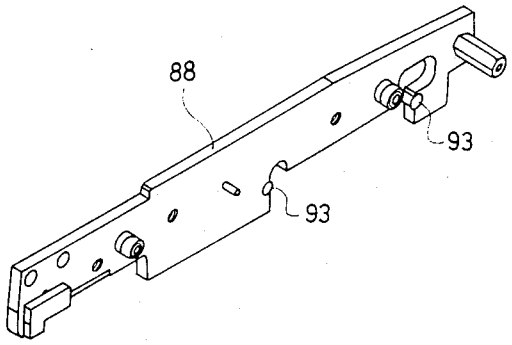

A round hole 92 (3.8 mm in diameter) is made at both ends of the groove 89 and a cushion 93 (made of urethane rubber or the like, about 4 mm in diameter, about 4 mm in thickness and about 60° in hardness) can be pressed into each hole 92 and fixed with an adhesive. In this case, that part of the cushion 93 which protrudes from the groove 89 is shaved off but as shown in FIG. 11, the cushion 93 may be left protruding.

The setting member 94 is almost the same as in the first embodiment. It has a notch 95 (6.5 mm in width $H_2$) at the rear part thereof. The notch 95 has a circular arc shape at its head part and has a concavity 96 (3 mm in radius $R_1$, 0.5 mm in depth $D_1$) at the rear. A notch 97 (4 mm in radius $R_2$, 4 mm in depth $D_2$) is provided in the undersurface of the central part of the setting member 94.

A sub member 98 and other parts are almost the same as in the first embodiment. Various parts constructed as described above are assembled as shown in FIG. 10.

Figure 12:
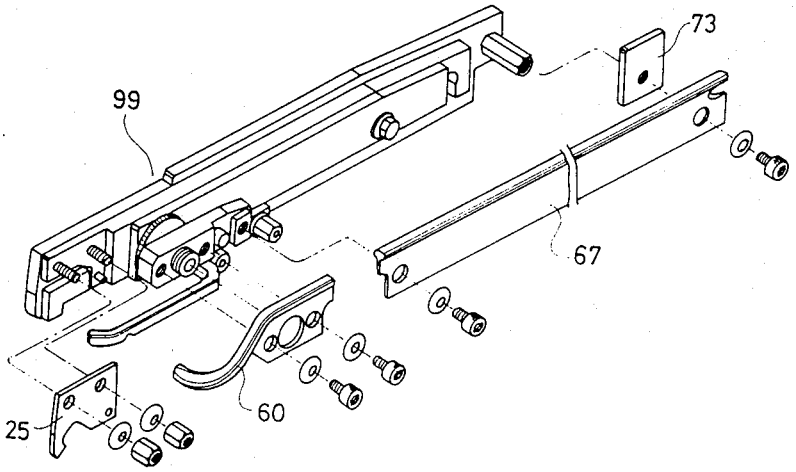

As shown in FIG. 12, the traveller setting plate 25, the traveller guide rail 60 and the traveller guide bar 67 are assembled so as to constitute a main mechanism 99.

Figure 13:
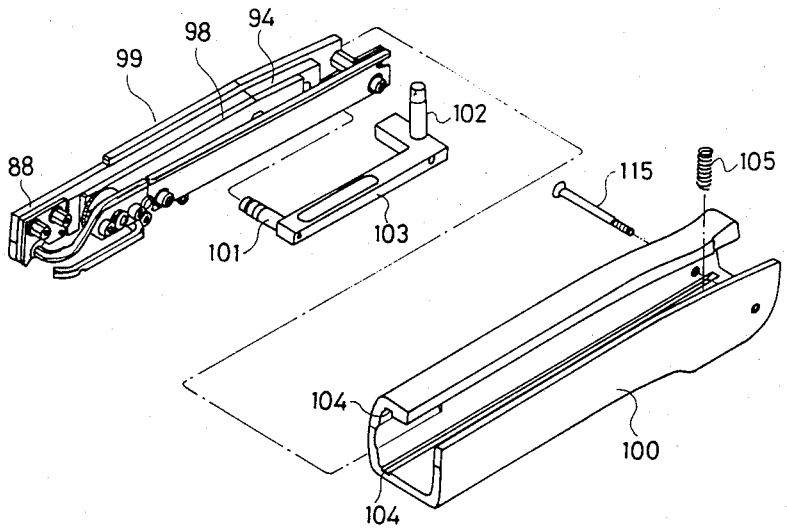

The assembling of the main mechanism 99 and case 100 is described below with reference to FIG. 13.

Figure 16:
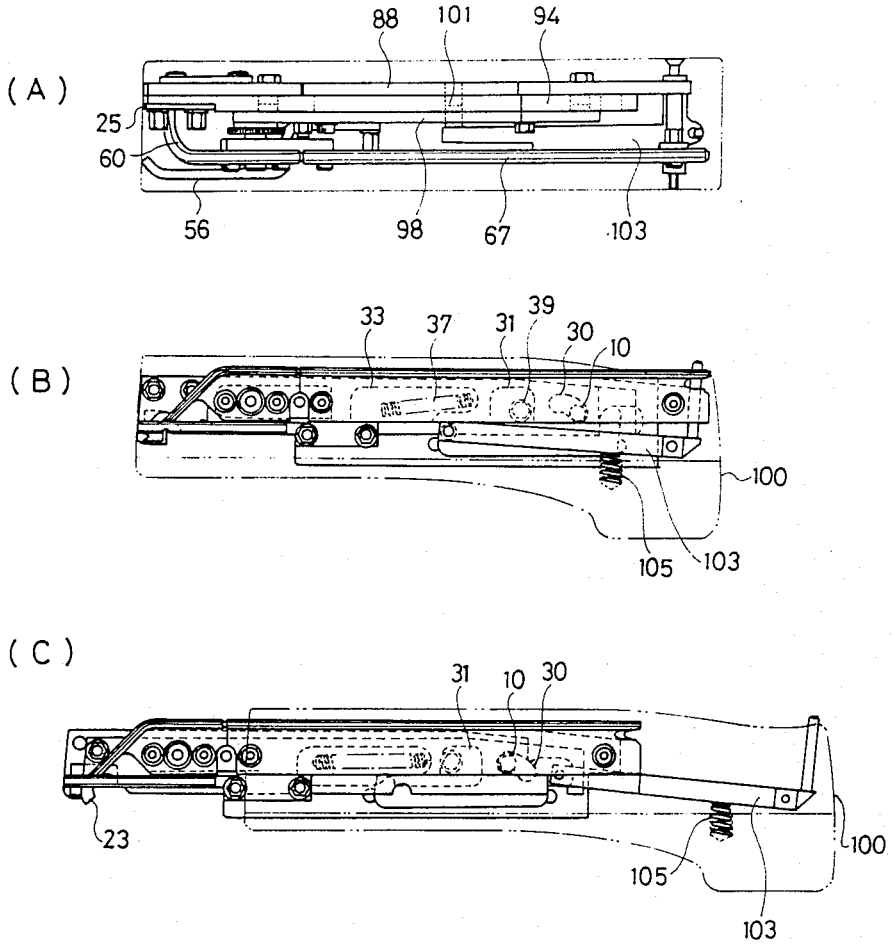

A working member 103 having a working pin 101 and a lever 102 is rockably mounted on the rear part of the case 100 by a pin 115 and the main mechanism 99 is fitted slidably in the case, with the upper and lower surfaces of the main member 88 fitted in grooves 104 made in the upper and lower parts of the case (see FIG. 16).

Figure 14:
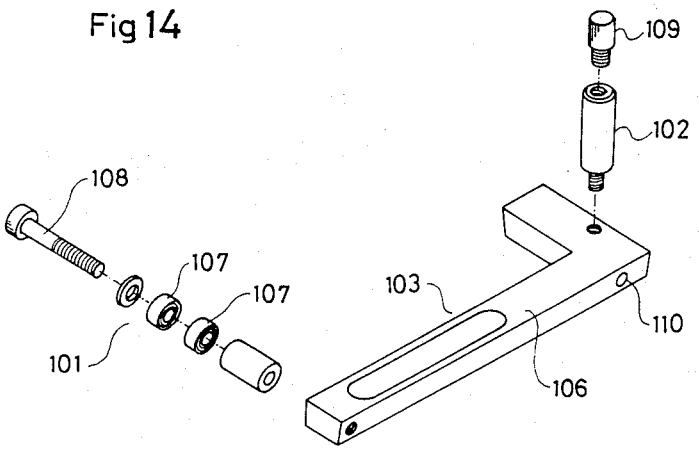

As shown in FIG. 14, the working member 103 comprises a main body 106 of L-like shape, the working pin 101 extending in the horizontal direction, a lever 102 with a thumb nut 109 screwed into the upper surface of the corner part of the L-shape and a hole 110 through which a pin 115 for mounting the working member 103 on the case passes. The working pin 101 comprises a bolt 108 and roller followers 107 rotatably mounted on the bolt 108 and its outer end portion is screwed into the main body 106. When mounting the main mechanism in the case, the working pin 101 is passed through the groove 89 of the main member 88 and the roller followers 107 are arranged to make constant contact with the undersurface between the notch 95 of the setting member 94 and the notch 97.

A compression spring 105 is interposed between the undersurface of the main body 106 of the working member 103 and the case 100 and pushes the working pin 101 upwards at all times. The compression spring 105 is inserted in a recess in the bottom of the case 100 so that it does not fall out.

Figure 15:
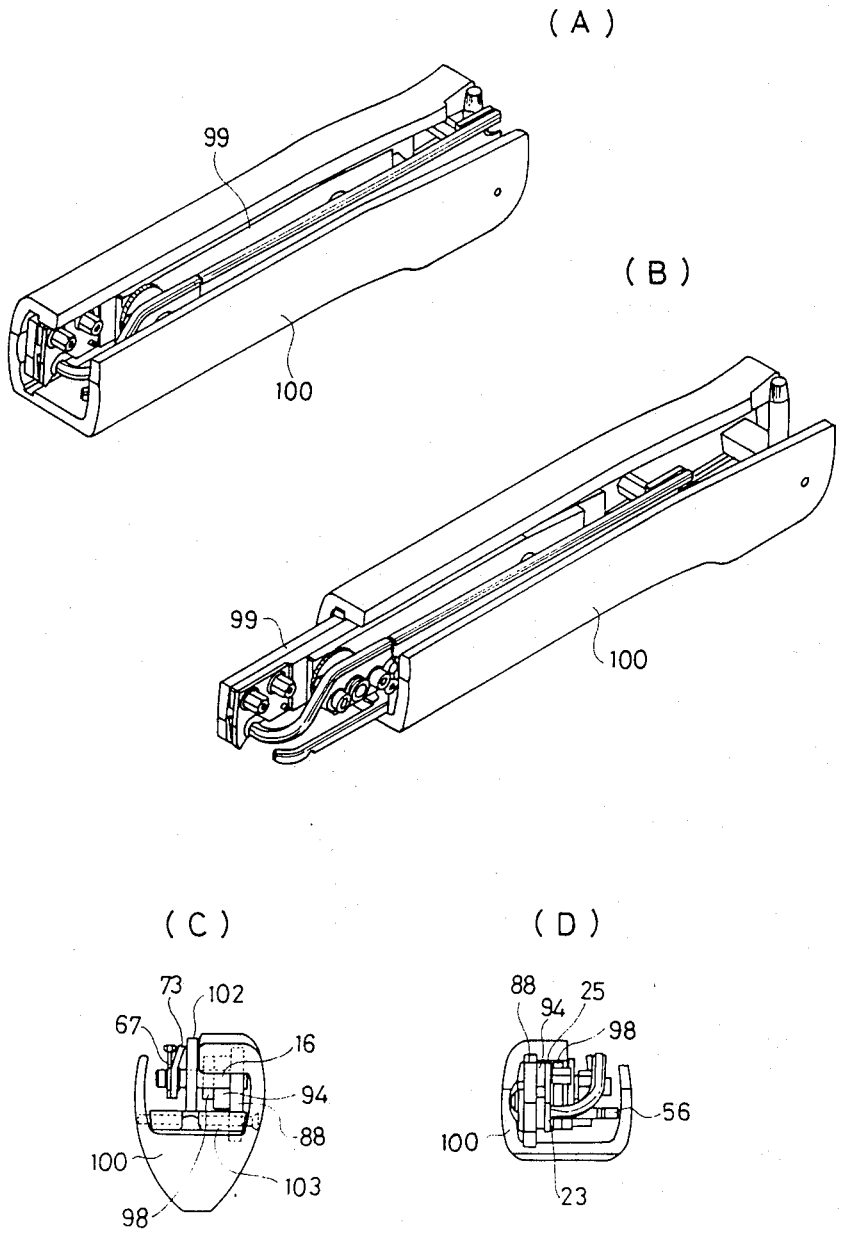

Since the second embodiment is constructed as stated above, in the case where the traveller setter is not used, the main mechanism 99 is encased in the case 100 and the working pin 101 of the working member 103 is engaged with the notch 97 in the undersurface of the setting member 94 to prevent the main mechanism 99 from coming out of the case, as shown in FIGS. 15A and 16A and 16B. In the case where the traveller setter is used, the thumb nut 109 of the lever 102 projecting from the case 100 is moved down to disengage the working pin 101 from the notch 97 and then the main mechanism 99 is slid out by tilting the case 100 frontward. The main mechanism 99 extending partly out of the case is held by the case 100 by the working pin 101 of the working member 103 being engaged with the recess 96 at the rear part of the setting member 94 by the action of the compression spring 105. Thus, the traveller setter is brought to the state of use, as shown in FIGS. 15B and 16C.

A description is given below about how to use the traveller setter of the first and second embodiments.

Figure 17:
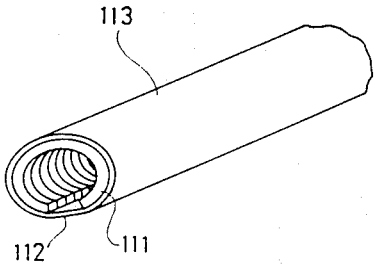
FIG. 17 is a perspective view, partly broken away, showing an embodiment of a traveller laminated cylindrical body to be used for the traveller setter according to the present invention.

As shown in FIG. 17, laminated cylindrical body 113 of travellers composed by laminating several tens of travellers and covering them with a tape 112 is put on the rail part 69 of the traveller guide bar 67, while pushing aside the traveller stopper 73. If the rear end of the traveller stopper 73 projects from the rear end of the rail part 69, the laminated cylindrical body 113 can be put on easily with one hand because the stopper 73 can be pushed aside by the laminated cylindrical body itself.

The tape 112 of the laminated cylindrical body 113 which has been put on the rail part 69 is cut by the cutting edge 72 provided at the rear end of the mounting part 70 of the traveller guide bar 67 and is separated from the travellers 111 and then is removed.

The travellers 111 put on the rail part 69 are further pushed along the rail part and the travellers 111 at the head portion are guided to the forward end portion of the rail part 62 of the traveller guide rail 60 and one of the travellers at the head portion is attracted to the plate 14 by the magnetic force of the magnet 13 on the main member 2 or 88.

Figure 18:
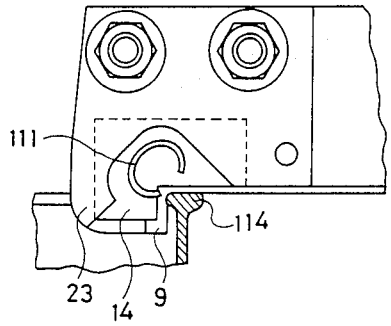
FIGS. 18A, 18B and 18C are side views, partly in section and on the enlarged scale, of a main part showing how a traveller is set on the ring flange part of the ring by using a traveller setter according to the present invention.
Figure 18:
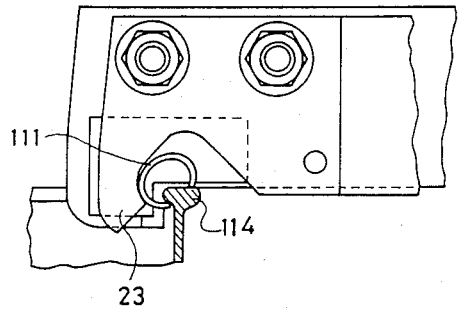
Figure 18:
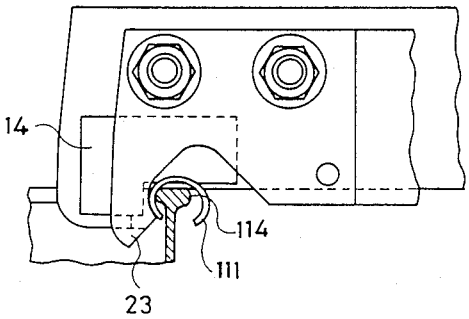

With traveller setter holding travellers in the above way, the guide seat 8 of the main member 2 or 88 is placed on the upper surface of a ring flange 114 of a spinning machine in such a fashion that the surface of the guide seat is level, as shown in FIG. 18A. At this time, the undersurface of the ring flange contacting part 56 of the bar 54 for determining position is contacted with the upper surface of the ring flange 114, so that the traveller setter can be easily leveled.

Then, by pulling the case 6 or 100, the projection 9 of the main member 2 or 88 makes contact with the inner surface of the ring flange and the setting member 4 or 94 which is moved relative to main member 2 by the working member 7 moves rearward and downward, being guided on the cam followers 10 in the guide grooves 30 as shown in FIG. 18B, and a leg end of the traveller 111 is pressed by the hook 23 and engaged with the inside of the ring flange.

If the case 6 or 100 is pulled further, the setting member 4 or 94 moves further rearward and downward, as shown in FIG. 18C, and the traveller 111 is pressed against the ring flange 114 by the hook 23 and is set on the ring flange.

When the traveller setter is taken off the ring flange 114, the setting member 4 or 94 is restored to its original position by the tension spring 37 and the next traveller 111 on the forward end of the traveller guide rail 60 is attracted by magnetic force to the plate 14, ready for setting on the ring flange.

In the above way, travellers are set one by one on the rings of ring spinning frames and twisting frames. When all of the travellers are set on the ring flange, with the traveller setter shown in the second embodiment, by pushing in the main mechanism 99 while moving the thumb nut 109 down or by directing the forward end of the traveller setter upward, the main mechanism 99 is encased in the case 100.

Third Embodiment

Figure 19:
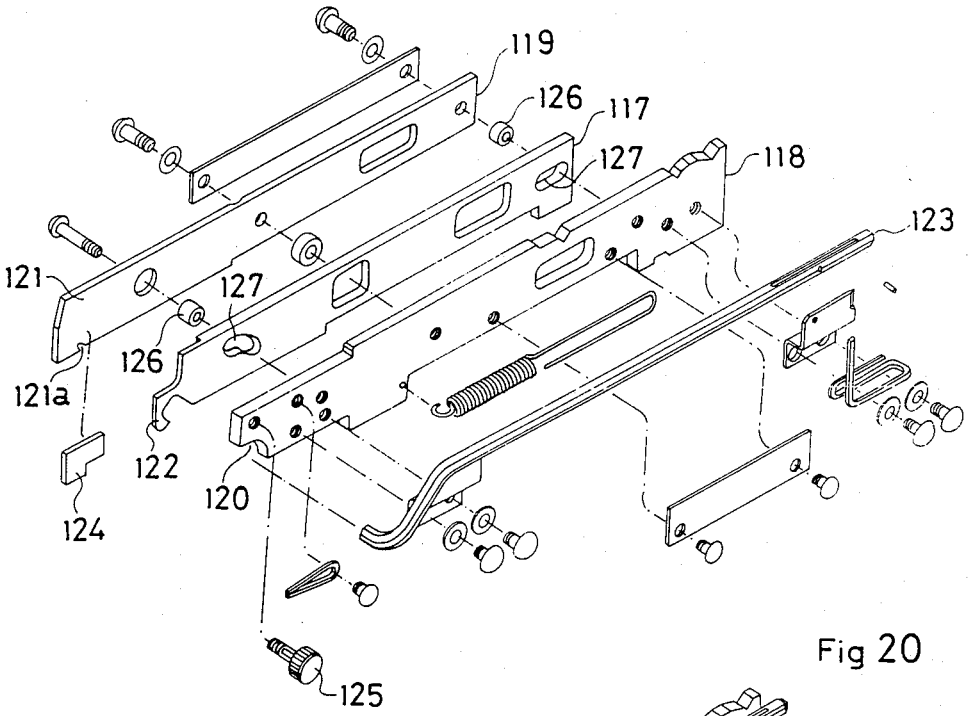
Figure 20:
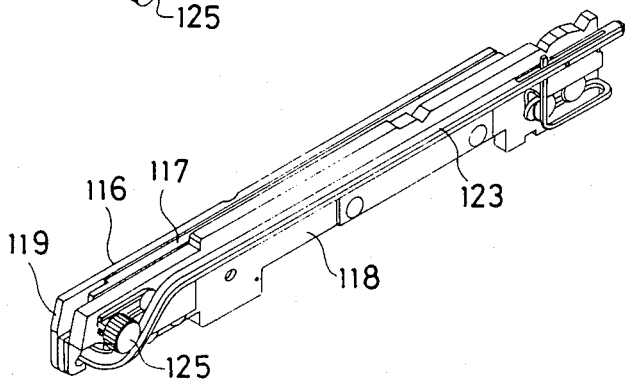

As shown in FIG. 19 and FIG. 20, in the main mechanism 116 the setting member 117 is sandwiched movably in between the sub member 118 and main member 119. A notch 120 through which travellers pass is provided at an extreme end of the sub member 118 and a projection 121 is provided at the lower part of a forward end of the main member 119. In the drawing, numeral 121*a* designates a yarn gripping concavity for gripping yarn.

A hook 122 is provided at a forward end portion of the setting member 117. A traveller guide rail 123 which guides travellers is fixed to the sub member 118. This guide rail 123 is bent in an L-like shape at its forward end and enters the notch 120 through which travellers pass made at the forward end of the sub member 118. Mounted on the forward end portion of the main member 118 which is at the portion corresponding substantially to the notch 120 of the sub member 118 is a magnet 124. Thus the traveller holding means is formed. The distance between the sub member 118 and the main member 119 at their forward end portion can be set as desired by turning a gauge adjusting screw 125. Normally, the distance is set a little wider than the width of a traveller to be set on a ring flange. Two cam followers 126 are fitted in guide grooves 127 provided in the setting member 117. The setting member 117 moves under the control of the cam followers.

Figure 21:
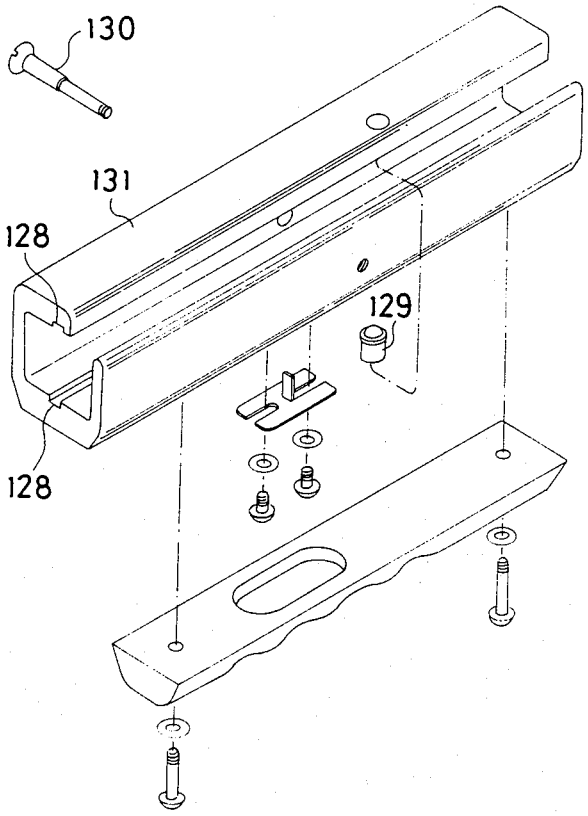
Figure 22:
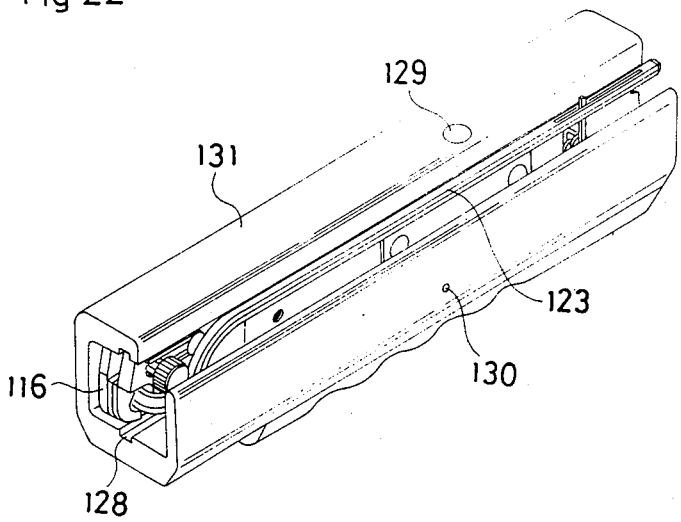

As shown in FIG. 21, a case 131 has an opening at an upper corner part so that travellers being put on the traveller guide rail 123 can be seen and is made of abrasion-resistant synthetic resin, such as nylon. Sliding grooves 128 are provided at about the center of the upper side and the lower side of the case. As shown in FIG. 22, the sub member 118 is fitted slidably in grooves 128 for sliding in the case 131 along the upper and lower surfaces thereof and the main mechanism 116 is received in the case 131. The arrangement is such that if the main mechanism 116 is received entirely in the case 131, a pin flange 129 at the upper part of the case 131 is fitted in a notch in the upper surface of the sub member 118. Numeral 130 designates a working member. This working member 130 engages with the rear end of a tension spring and makes contact with a shoulder part on the undersurface of the setting member 117, whereby the setting member 117 is moved relative to the main member by the movement of the case 131 and returned by the spring.

Figure 23:
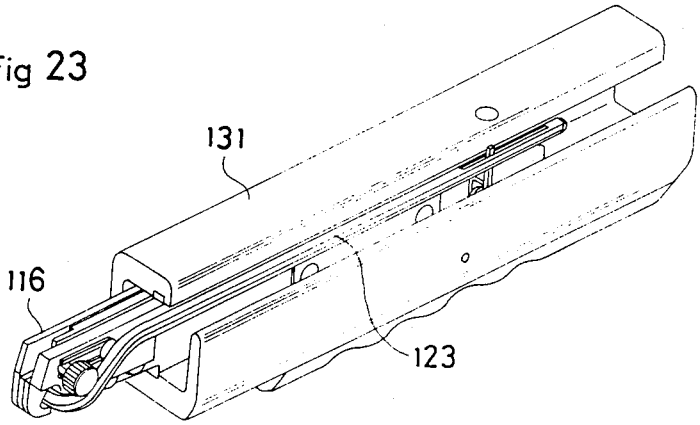

In the traveller setter of the third embodiment, if the main mechanism 116 is moved out of this case, from the state shown in FIG. 22 to the state shown in FIG. 23, the pin flange 129 is fitted in another notch in the upper surface of the sub member 118 for fixing the position of the traveller setter.

If the traveller is tilted, a traveller loosely put on the traveller guide rail slides down an inclined part at the forward end of the traveller guide rail and is attracted by magnetic force to the magnet 124 of the traveller holding part of the main member 119. In this state, the projection 121 of the main member 119 is hitched to the inside of the ring flange on the spinning machine or the like and then the case 131 is pulled outwardly of the ring flange, whereupon the setting member 117 is moved rearward by the working member 130 provided in the case 131 and a hook 122 at the outer end of the setting member 117 presses a traveller over the ring flange. Then, if the traveller setter is removed from the ring flange, the setting member 117 returns to its original state by the force of the tension spring and is ready for the next setting of a traveller.

If the use of a traveller setter ends, the main mechanism 116 is pushed in and is encased safely in the case, as shown in FIG. 22.

In each of the above embodiments, if a spinning yarn is passed through concavities in the yarn gripping part provided on the guide seat of the main member and at the position determining bar, the spinning yarn can be engaged within the traveller at the same time as setting of the traveller on the ring flange.

Numerical values, quality of material, etc. of various parts shown in the embodiments of the present invention can be changed in design, without departing from the gist of the present invention.

According to the present invention, a traveller setter holds travellers one by one by a magnet and a traveller held by a magnet and travellers on a travellers guide ral are separated completely from each other. Therefore, travellers are fed out smoothly without tanglement of adjoining travellers. Moreover, as travellers are set on the ring flange of a spinning machine or the like along the internal shape of a hook provided on the setting member, deformation of travellers does not take place.

Furthermore, upon setting of a traveller on a ring flange, the next traveller is attracted to the magnetic plate by magnetic force and therefore unsatisfactory setting of travellers does not occur. Hence, travellers can be set on a ring flange with high efficiency and no special skill is required for traveller setting. In addition, depending on the difference in width of travellers, micro adjustment of the space between the top end of the guide rail and a magnet can be effected by a gauge adjusting screw.

As the traveller setter according to the present invention is of compact size, it can be handled easily.

I claim:

1. A traveller setter for setting travellers on a ring flange of a spinning machine or the like, comprising:

an elongated case having an opening at a forward end thereof and serving as a handle for said traveller setter;

a main mechanism slidably mounted in said case for movement out of an into said case through said forward opening, said main mechanism having:

a plate-shaped main member having on the under surface of the forward end portion thereof a horizontal guide seat for contacting the upper surface of a ring flange, and a magnet fixed to a side surface of said forward end portion;

a plate-shaped sub-member mounted in spaced opposed relation to said side surface of said main member and substantially in parallel with said main member;

a plate-shaped setting member movably mounted between said main member and said sub member for movement in the forward and backward directions, said setting member having at the forward end thereof a traveller setting hook having an inner surface curved for holding the back of a traveller attracted by the magnet on said main member;

a traveller guide rail having a forward end portion curved downwardly and laterally into spaced opposed relation with said magnet; and a working member on said case and engaged with said setting member for causing said setting member to move with said casing when said main member is engaged with a ring flange and said casing is moved away from the ring flange for causing the hook on said setting member to force the traveller ring onto the ring flange.

2. A traveller setter as claimed in claim 1 in which said setting member has a plurality of kidney-shaped guide grooves therein, and said main mechanism has cam followers mounted between said main member and said sub member and engaged in said guide grooves for guiding said setting member in forward and downward movement relative to said main member as said traveller setter is moved away from said ring flange.

3. A traveller setter as claimed in claim 1 in which said working member is a pin-shaped member extending through said case perpendicular to the direction of sliding movement of said main mechanism and engaging said setting member.

4. A traveller setter as claimed in claim 1 in which said working member is an L-shaped lever having the longer leg extending forwardly in said case parallel to said main member and having a rear end pivotally mounted in said case, a working pin extending laterally of said main member from the forward end of said longer leg for engagement with said setting member, and a lever projecting upwardly from the upper surface of the rear end of the said L-shaped lever and out of said case, said traveller setter further having a spring means in said case engaged with said L-shaped member for urging the forward end of said longer leg upwardly for urging said working pin against the under side of said setting member, said setting member having a notch in the under side thereof in which said working pin engages when said main mechanism is extended from said case.

5. A traveller setter as claimed in claim 1 further comprising a guide seat member detachably mounted on said guide seat.

6. A traveller setter as claimed in claim 5 in which said guide seat member is of wear resistant material.

7. A traveller setter as claimed in claim 5 in which said guide seat member has a downward extending portion defining a corner for engagement over a ring seat, and said guide seat member has yarn receiving concavity in said corner.

8. A traveller setter as claimed in claim 1 further comprising a gauge adjusting screw having a further magnet on the back thereof and positioned between the front end of said sub member and the outer end portion of said traveller guide rail for attracting said traveller guide rail thereto and permitting adjustment of the position of the end of said traveller guide rail relative to said firstmentioned magnet.

9. A traveller setter as claimed in claim 1 in which said guide seat has a downward extending portion defining a corner for engagement over a ring seat, and said guide seat has a yarn receiving concavity in said corner.

10. A traveller setter as claimed in claim 1 further comprising a posture determining bar spaced laterally of the front portion of said sub member on the opposite side thereof from said main member and having a ring flange contacting surface on the under side thereof, said contacting surface being parallel with and on the same level as said guide seat.

11. A traveller setter as claimed in claim 10 in which said lower part of the forward end of said posture determining bar has a concavity therein for receiving a yarn.

* * * * *